United States Patent [19]

Camardella

[11] Patent Number: 4,662,573

[45] Date of Patent: May 5, 1987

[54] COIL WINDER IN LINE WITH TWO GUIDE HEADS

[75] Inventor: Giuseppe Camardella, Saronno, Italy

[73] Assignee: Tekma Kinomat S.p.A., Caronno Pertusella, Italy

[21] Appl. No.: 719,538

[22] Filed: Apr. 3, 1985

[30] Foreign Application Priority Data

Apr. 12, 1984 [IT] Italy ..... 20508 A/84

[51] Int. Cl.[4] ..... H01F 41/06

[52] U.S. Cl. ..... 242/7.11

[58] Field of Search ..... 242/7.11, 7.14, 7.09, 242/7.02, 82; 140/92.1

[56] References Cited

U.S. PATENT DOCUMENTS

| | | | |
|---|---|---|---|
| 3,658,269 | 4/1972 | Camardella | 242/7.09 |
| 3,713,599 | 1/1973 | Smith et al. | 242/7.11 |
| 4,157,165 | 6/1979 | Bierman et al. | 242/7.14 |
| 4,185,789 | 1/1980 | Camardella | 242/7.11 |

*Primary Examiner*—Billy S. Taylor

*Attorney, Agent, or Firm*—Young & Thompson

[57] ABSTRACT

The invention relates to a coil winder of the type so-called "in line", wherein the coil supports are carried by a plurality of parallel, rotating spindles, and the wire-guides for feeding and distributing the wire to the coils are mounted on a single support bar, adopted to be moved according to the three cartesian axes. According to the invention, the bar is supported at its two ends by two identical support and guide heads, subjected to a single movement control system on the three axes.

6 Claims, 3 Drawing Figures

3
10
22b
22
1
26
25
22a
23a
15
24
23
24a
III
10
III
18
14
17
16
2

3
18a
1
24b
5
4
24
18a
23
2

COIL WINDER IN LINE WITH TWO GUIDE HEADS

BACKGROUND OF THE INVENTION

It is known that for the winding of coils to be employed in the electric and/or electronic field, use is made of widely different types of automatic machines, which are adapted to satisfy even very different production requirements.

The present invention relates to a coil winder of the type so-called "in line". In these machines the coil support is essentially in the form of a rectilinear bar, on which are mounted as many rotating spindles as the number of coils to be simultaneously wound. The spindles, each of which carries a coil support, are controlled in their rotation speed and in the number of turns and/or turn fractions which they perform at each cycle.

In front of the rectilinear bar supporting the spindles, and parallel thereto, a second bar is arranged, with wireguides mounted thereon, one in correspondence of each of the spindles or coils. Said bar carrying the wireguides is moved to cause all the wireguides, in parallel, to perform movements so as to distribute the wires on the respective coils, or to twist the wire ends on the coil terminals, or even to lead the wires along other special paths.

According to known technique, said bar carrying the wireguides is centrally supported by a head controlling the movements, which is adapted to perform movements according to the three cartesian axes. Thereby, each wireguide mounted on the bar can be caused—for instance under numerical control—to perform movements in any desired direction.

The main drawback of these machines lies in the system for supporting the wireguides carrying bar. In fact, taking into account that said bar is normally of considerable length—for instance, of the order of 100–120 cm, which is indispensable for carrying about twenty wireguides in parallel—the support thereof, in a central position, is not adapted to guarantee a reliable control of the bar itself.

In other words, the cantilevered support of each half of the bar in respect of the centrally positioned control head the inevitable slck between guides and slides performing movements according to the three axes, as well as the actual flexibility of the bar itself, are all factors which—under the stresses and vibrations produced by the wire sliding in the wireguides—are considerably harmful for the perfect control of the wireguides, especially those positioned closer to the ends of said bar. For these reasons, it is also practically impossible to use bars of a length exceeding that specified heretofore, the control of which would cause great problems.

This is why the above coil winders in line have been, up to date, mainly designed to satisfy requirements of high production speeds, not caring about a high precision in the control of the wireguides and, thus, in the production of the coils.

As a matter of fact, it has also been provided to manufacture coil winders in line, having enough precision in the guiding of the bar, for instance by producing the control head with slackless guides, or with the possibility to adjust the slack; nevertheless, such machines are first of all extremely costly and difficult to set up and, furthermore, through wear, they are apt after a short while to suffer the same drawbacks which have been pointed out hereabove.

SUMMARY OF THE INVENTION

The object of the present invention is to realize a coil winder of the general type heretofore described, providing for a high precision in the control of the wireguides, to the extent of allowing even the use of considerably longer or heavier bars than those of known technique, with the performances and advantages better explained hereinafter. This result is obtained essentially due to the fact that said coil winder comprises a main support head incorporating guide means for motion on the three orthogonal axes, main control means for said guide means associated with said main head, and a secondary identical support head, which in turn incorporates secondary guide means for motion on the three orthogonal axes, interlocked with said main control means, the bar carrying the wireguides being mounted with one end on the main head and with the other end on the identical secondary head.

According to a preferred embodiment, the interlocking of the secondary head with the main control head is simply obtained by way of a transmission, particularly by a toothed belt drive, which connects said control means of the main head to the guide means for motion of said head and, respectively, to the guide means for motion of the secondary interlocked head.

As can be easily understood, the fact that the wireguides carrying bar is supported at the two ends, and not centrally, eliminates altogether the aforementioned problems of control of the wireguides, in that it overcomes the effect of guide slack, as well as any phenomenon of flexibility or vibration of the bar. On the other hand, it has surprisingly been found that by simply interlocking the two heads in the manner heretofore described, it is possible to obtain a perfect parallelism of the movements of said heads, such as to guarantee a perfect parallelism of the movements of the single wireguides throughout the length of the bar.

It has actually been possible to ascertain that there are no obstacles either to the construction of bars which are considerably longer than those of known technique, and thus carrying a larger number of wireguides, or even to the construction of bars carrying, in replacement of the known fixed wireguides, rotary wireguides or "flyers", with evident advantages in the case of machines with higher performances.

BRIEF DESCRIPTION OF THE DRAWINGS

Further characteristics and advantages of the coil winder according to the present invention will anyhow be more evident from the following description of a preferred embodiment thereof, given by way of non-limiting example and illustrated in the accompanying drawings, in which.

Figure 1:
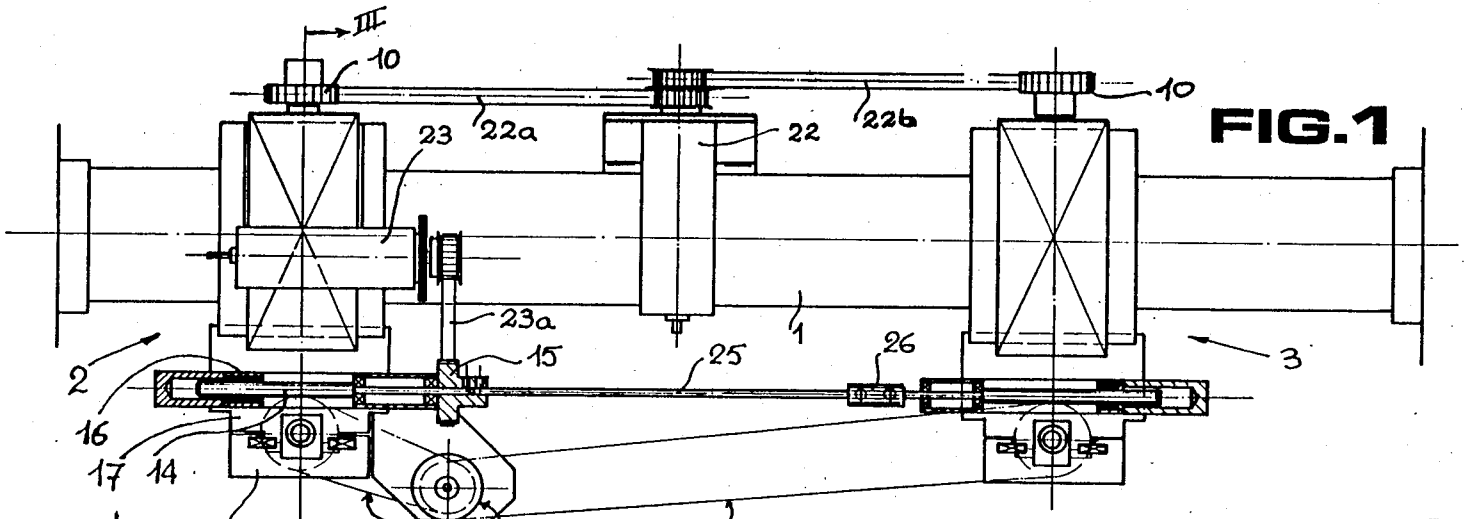
FIG. 1 is a diagrammatic, partly sectioned, front view of the coil winder in line according to the invention.
Figure 2:
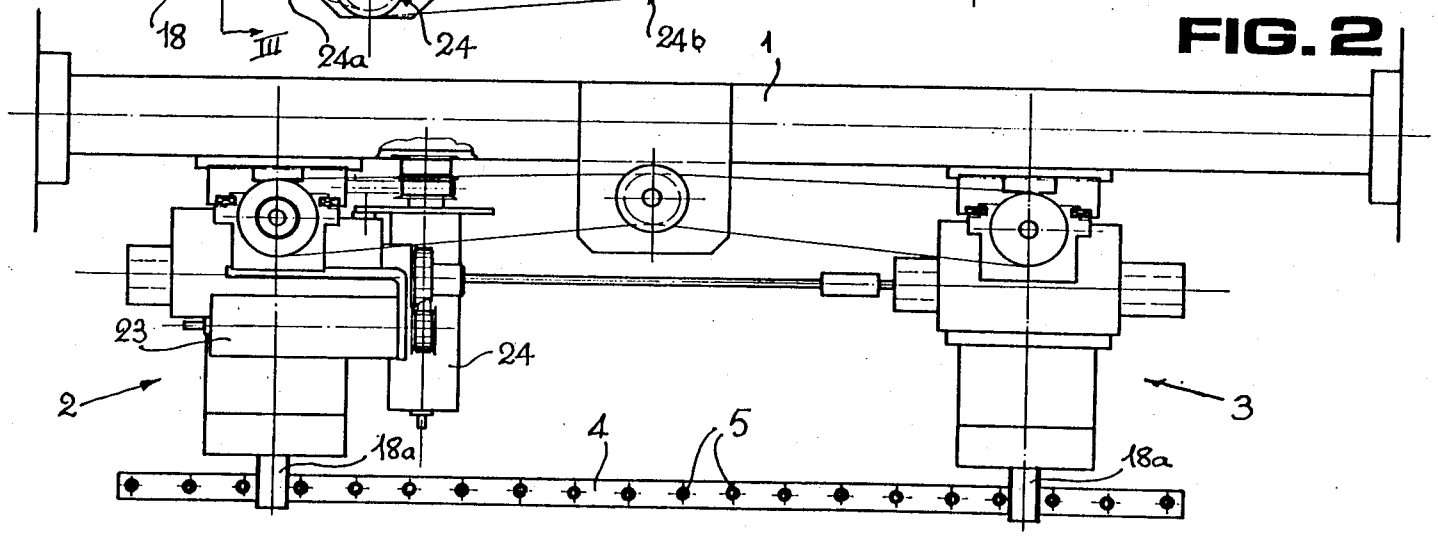
FIG. 2 is a diagrammatic plan view of the same machine.
Figure 3:
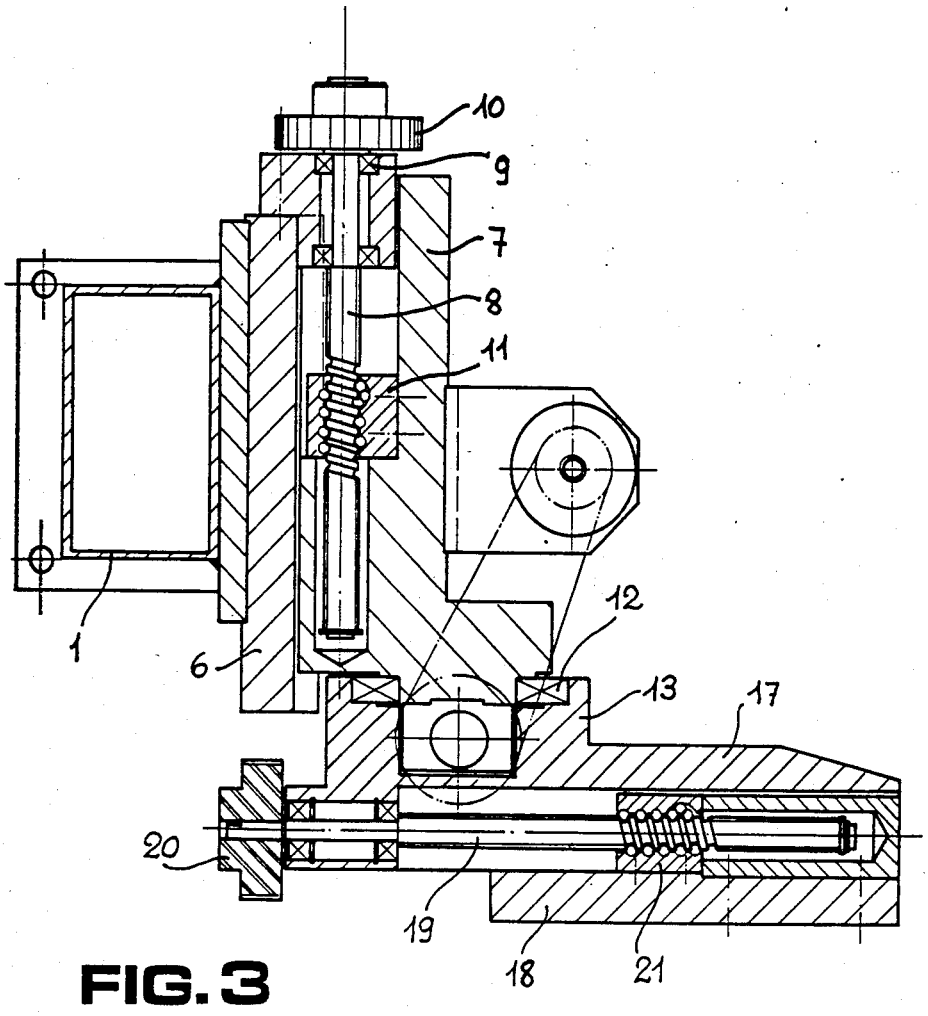
FIG. 3 is a cross section view along the line III—III of FIG. 1.

As shown, the machine comprises a frame 1—of which only a main support cross member is represented in the drawings—on which are mounted the main head 2 and the secondary interlocked head 3 supporting the bar 4 carrying the wireguides 5.

The two heads 2, 3 are exactly identical, as they comprise the same components, indicated in the drawings by the same references, and precisely:

a first vertical guide 6, fixedly mounted on the cross member 1;

a first slide 7, slidable vertically (axis Z) along the guide 6;

first driving means for movement of the slide 7, comprising a worm screw 8 and a lead nut 11. The screw 8 is rotatable, but not slidable, in a bearing 9 fixed to the guide 6, and a gearwheel 10 is keyed on the outer upper end thereof. The lead nut 11, which is fixed to the slide 7, engages with the worm screw 8 so that each rotation of said screw develops into an axial movement of the slide 7;

a second guide 12, formed as an integral part of the slide 7 at the bottom end thereof;

a second slide 13, slidable on the guide 12 in a horizontal longitudinal direction, i.e. parallel to the cross member 1 of the machine (axis X);

second driving means for movement of the slide 13, consisting of a worm screw 14, at the outer end of which is keyed a gearwheel 15 (see FIG. 1), and of a lead nut 16 fixed to the slide 13;

a third guide 17, formed as an integral part of the slide 13 and also disposed at the bottom end of this latter;

a third slide 18, slidable on the guide 17 in a horizontal transverse direction, i.e. perpendicular to the cross member 1 (axis Y);

third driving means for movement of the slide 18, consisting of a worm screw 19, on the outer end of which is keyed a gearwheel 20, and of a respective lead nut 21.

The two opposite ends of the bar 4 carrying the wireguides 5 are fixed on the outermost end 18*a* of the slides 18 of the two heads 2, 3.

It should be noted that, thanks to the arrangement according to the invention, wherein the guides and slides are not subject to torsional stresses—as happens instead in the known machines, having a single central head—said guides and slides can be produced with less costly techniques. In particular, instead of the known arrangements with guides in the form of shafts and slides having ball bushings with slack take-up, it is possible to adopt prismatic guides with preloaded rollers, which are far easier to find on the market.

It should also be noted that, thanks to the guide structure of the bar 4, according to the present invention, which is far more precise, more stable and better supported, it is possible—as already said—to replace the simple wireguides 5 shown in the drawings, by rotary wireguides or "flyers". In this case, the bar 4 will carry a bushing for rotation of each wireguide, and a drive connected to all the wireguides, as well as a controlled motor, while the coil support is held stationary.

Such an arrangement is particularly advantageous, as it extends the machine planning possibilities to new uses: for instance, it allows to wind rectangular coils, which was practically impossible with the coil winders in line of known technique.

The control means of said guide means for movement of the heads comprise position control motors, for instance direct current motors with feedback, or stepping motors, under numerical control. The motor 22, the casing of which is fixed on the cross member 1, performs the control according to the axis Z, that is, it controls the movements of the slides 7, whose guides 6 are also fixedly mounted on the cross member 1. The motor 23, the casing of which is fixed on the slide 7 of the head 2, performs the control according to the axis X, that is, it controls the movements of the slide 13, whose guide 12 is also fixed on the same slide 7. The motor 24, the casing of which is fixed on the slide 13 of the head 2, performs the control according to the axis Y, that is, it controls the movements of the slide 18, whose guide 17 is in turn fixed on the same slide 13.

As will be evident from the drawings, the control of the motor 22 is transmitted in an identical manner to the two heads 2, 3, by way of the two belt drives 22*a*, 22*b*, which mesh with the gearwheels 10 of these two heads.

Also the control of the motor 23 is identically transmitted to the two heads 2, 3, by way of the toothed belt 23*a*, which meshes with the gearwheel 15 associated with the head 2. In this case, considering that the worm screws 14 of the two heads 2, 3 are coaxial, the control from one head to the other is transmitted by way of a shaft 25, possibly having a joint 26, the two opposite ends of said shaft being fixed directly onto said two worms 14.

Finally, also the control of the motor 24 is identically transmitted to the two heads 2, 3, by way of two belt drives 24*a*, 24*b*, which mesh with the gearwheels 20 of the two heads.

Thus, on the one hand, owing to the perfect likeness in the construction of the two heads 2, 3, and particularly of the respective guide means 6–11, 12–16, 17–21, and, on the other hand, thanks to the interlocking obtained by means of the drives 22*a*–22*b*, 25, 24*a*–24*b*, the numerically controlled motor means 22, 23, 24, undergo a perfect parallelism of movement of the ends 18*a* supporting the bar 4, and thus a perfect parallelism in the movements of the two ends of said bar. This obviously determines a perfect parallelism in the movements of the single wireguides 5, whatever the length of the bar 4, or its weight.

It is to be understood that invention has been described above with reference to a preferred embodiment thereof, but that this should by no means be considered in the restrictive sense, as many other embodiments can be realized, all within reach of an expert in the art, but all falling within the protection scope of the invention itself.

I claim:

1. For use with a coil winder of the type having coil supports carried by a plurality of parallel rotating spindles mounted on a first stationary support, wireguides for feeding and distributing wire to coils, said wireguides being mounted on a single support bar, adapted to be moved according to the three orthogonal axes, a main support head incorporating guide means for movement on the three orthogonal axes, main control means for said guide means associated with said main head, and a secondary identical support head, which in turn incorporates secondary guide means for movement on the three orthogonal axes, interlocked with said main control means, the bar carrying the wireguides being mounted by one end on the main head and by the other end on the identical secondary head.

2. Apparatus as in claim 1, wherein said main control means for said guide means comprise position control motors having numerical control.

3. Apparatus as in claim 1, wherein said guide means for movement of each support head comprise: a first guide fixedly connected to a frame of the winder and a first slide slidable on said first guide; a second guide fixedly connected to the first slide and a second slide slidable on said second guide; and a third guide fixedly connected to the second slide with a third slide slidable on said third guide, said third slide supporting the bar carrying the wireguides.

4. Apparatus as in claim 3, wherein said guide means also comprise a worm screw and nut system for each guide and slide pair, means mounting the worm screw rotatably but not slidably on the guide, and a lead nut fixedly connected to the slide.

5. Apparatus as in claim 4, wherein a driving gearwheel is keyed on one of the worm screw ends.

6. Apparatus as in claim 2, wherein a first position control motor is fixed on a frame of the winder and controls the motion of the first slide of the main head, a second position control motor is fixed on said first slide of the main head and controls the motion of the second slide of the main head, and a third position control motor is fixed on said second slide and controls the motion of the third slide of the main head.

* * * * *